US006564438B1

(12) United States Patent
Bertsch et al.

(10) Patent No.: US 6,564,438 B1
(45) Date of Patent: May 20, 2003

(54) METHOD FOR AIR-BUBBLE TEXTURING ENDLESS FILAMENT YARN, YARN FINISHING DEVICE AND ITS USE

(75) Inventors: Gotthilf Bertsch, Ebnat-Kappel (CH); Kurt Klesel, Wolfhalden (CH)

(73) Assignee: Heberlein Fibertechnology, Inc., Wattwil (CH)

( * ) Notice: Subject to any disclaimer, the term of this patent is extended or adjusted under 35 U.S.C. 154(b) by 0 days.

(21) Appl. No.: 09/623,394

(22) PCT Filed: Mar. 3, 1999

(86) PCT No.: PCT/CH99/00098

§ 371 (c)(1),
(2), (4) Date: Nov. 7, 2000

(87) PCT Pub. No.: WO99/45182

PCT Pub. Date: Sep. 10, 1999

(30) Foreign Application Priority Data

Mar. 3, 1998 (CH) ..... 499/98

(51) Int. Cl.[7] ..... D02G 1/16; D02J 1/08
(52) U.S. Cl. ..... 28/274; 28/271; 28/276
(58) Field of Search ..... 28/271, 274, 276, 28/273, 258, 275, 249, 246, 220; 57/908, 333, 350, 351, 289, 290

(56) References Cited

U.S. PATENT DOCUMENTS

| | | | | |
|---|---|---|---|---|
| 3,525,134 A | | 8/1970 | Coon | |
| 3,751,767 A | | 8/1973 | Marshall | |
| 3,754,694 A | | 8/1973 | Reba | |
| 4,004,329 A | * | 1/1977 | London et al. | 28/274 |
| 4,011,640 A | * | 3/1977 | Keith | 28/274 |
| 4,040,154 A | | 8/1977 | Riley | |
| 4,074,511 A | * | 2/1978 | Chambley et al. | 28/274 |
| 4,080,778 A | * | 3/1978 | Adams et al. | 282/274 |
| 4,115,988 A | * | 9/1978 | Nakagawa et al. | 28/274 |

(List continued on next page.)

FOREIGN PATENT DOCUMENTS

| | | |
|---|---|---|
| DE | 38 23 538 | 2/1990 |
| EP | 839493 | 6/1960 |
| EP | 0 088 254 | 9/1983 |
| GB | 2 287 256 | 9/1995 |
| WO | 97/30200 | 8/1997 |

OTHER PUBLICATIONS

A. Demir, "A Study of Air–Jet Texturing Nozzles: The Effects of Nozzle Configuration on the Air Flow", Transactions of the ASME; Journal of Engineering for Industry, vol. 112, pp. 97–104, (1990).

*Primary Examiner*—A. Vanatta
(74) *Attorney, Agent, or Firm*—Finnegan, Henderson, Farabow, Garrett & Dunner, L.L.P.

(57) ABSTRACT

A method and machine for treating yarn may include feeding the yarn through both a heat treatment and an air jet texturing nozzle. The texturing nozzle may be supplied with compressed air, producing an air jet with a speed greater than Mach 1 in the yarn channel. The heat treatment may be performed before and/or after feeding the yarn through the texturing nozzle.

35 Claims, 9 Drawing Sheets

U.S. PATENT DOCUMENTS

Figure 1:
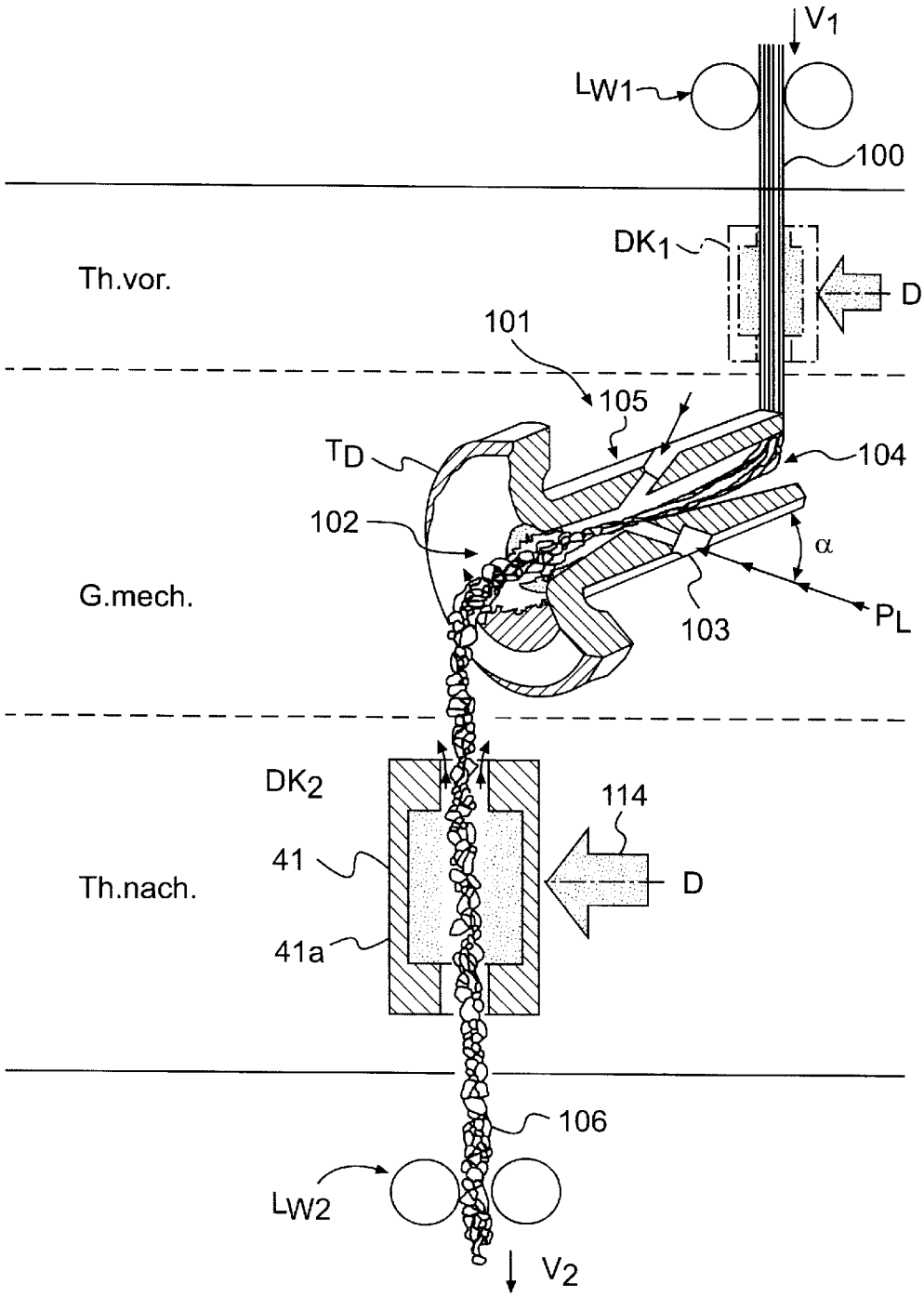

| | | | | | |
|---|---|---|---|---|---|
| 4,157,605 | A | | 6/1979 | Agers | |
| 4,345,425 | A | * | 8/1982 | Negishi et al. | 28/220 |
| 4,365,394 | A | * | 12/1982 | Matsumoto et al. | 28/258 |
| 4,507,833 | A | | 4/1985 | Simmen | |
| 4,535,516 | A | | 8/1985 | Egbers et al. | |
| 4,567,720 | A | * | 2/1986 | Price | 28/271 |
| 4,574,436 | A | | 3/1986 | Cullen, Jr. | |
| 4,581,886 | A | | 4/1986 | Coll-Tortosa | |
| 4,877,572 | A | | 10/1989 | Clarke et al. | |
| 5,003,677 | A | | 4/1991 | Krenzer | |
| 5,040,276 | A | * | 8/1991 | Coons et al. | 28/258 |
| 5,054,174 | A | * | 10/1991 | Krenzer | 28/271 |
| 5,140,729 | A | | 8/1992 | Simmen | |
| 5,241,730 | A | | 9/1993 | Simmen et al. | |
| 5,325,572 | A | * | 7/1994 | Dickson, III et al. | 28/271 |
| 5,579,566 | A | | 12/1996 | Burkhardt et al. | |
| 5,640,745 | A | | 6/1997 | Bertsch et al. | |
| 5,713,113 | A | | 2/1998 | Demir | |
| 5,802,836 | A | * | 9/1998 | Curran et al. | 28/271 |
| 6,088,892 | A | | 7/2000 | Bertsch et al. | |

* cited by examiner

STATE OF THE ART

METHOD FOR AIR-BUBBLE TEXTURING ENDLESS FILAMENT YARN, YARN FINISHING DEVICE AND ITS USE

TECHNICAL SCOPE

This invention relates to a method of air jet texturing of continuous filament yarn with an air jet texturing nozzle having a continuous yarn channel at whose one end the yarn is supplied and at whose other end the textured yarn is removed, and compressed air is supplied to the yarn channel in a central section, and in an enlarging acceleration channel the air blast jet is accelerated to a supersonic speed, and loop yarn is produced at a high rate of transport of preferably more than 600 m/min, where the air jet texturing zone is bordered by a feeder roll 1 at the beginning of the air finishing stage and a feeder roll 2 at the end of the air finishing stage.

This invention also relates to a yarn finishing machine with a texturing zone consisting of a feeder roll 1 for supplying the yarn, a texturing nozzle and a feeder roll 2 downstream from the texturing nozzle, where the texturing nozzle has a continuous yarn channel at whose one end the yarn is supplied and at whose other end the textured yarn is removed, and compressed air is supplied to the yarn channel in a central section and an air blast jet at a supersonic speed can be generated in an expanding acceleration channel.

STATE OF THE ART

This invention is based on air jet texturing according to International Patent WO97/30200. Finishing of continuous filament yarn must fulfill mainly two functions. First, a textile character is to be imparted to the yarn produced from industrially synthesized filaments, and technical textile properties are to be imparted. Secondly, the yarn is to be finished from the standpoint of specific quality features of the end product which often cannot be achieved with products manufactured from natural fibers. A very important goal with industrially produced filaments and the yarns and textiles produced from them is to optimize the processing operation. Optimizing here means maintaining or increasing certain quality criteria and reducing production costs. It is known that production costs can be reduced in various ways, The most obvious way is to increase throughput speed in a given production facility. Another possibility involves technical process measures that need not necessarily include an increase in throughput speed but instead ensure certain quality criteria even at high yarn throughput speeds.

Especially in the case of continuous filaments, the textile industry is one of the most complex branches of the industry since several independent branches of the industry and commerce are involved from the raw material stage to the finished fabric. None of these branches is completely autonomous, and instead there is a processing chain where any change in process in one stage can influence the following stages or even preceding stages. However, it is still not known whether the final consumer will accept or reject the product after changes with respect to quality properties have occurred due to new process techniques. In some product sectors, especially in filament spinning mills, yarn finishing through yarn finish nozzles is the most important step. The change in structure from smooth yarn to a textured loop yarn is achieved merely through mechanical air forces. Air flow in the supersonic range is generated, as described in the above-mentioned International Patent WO 97/30200. All attempts known so far have shown that the texturing effect hardly changes when using, for example, hot air for the blasting air in the nozzle. The simplest explanation for this is that hot compressed air expands suddenly, cooling at the same time. The heating effect of heated air is mostly lost with this expansion and the corresponding cooling effect.

Unexamined German Patent No. 2,822,538 describes a method of producing PET carpet yarn. This method is stuffer box crimping which is carried out as an integrated process within a spin draw texturing process with transport rates of more than 1800 n/min. In stuffer box crimping, deformation of the yarn is supported chemically in contrast with air jet texturing where air force alone produces the deformation effect.

U.S. Pat. No. 4,040,154 describes another example of stuffer box crimping using superheated steam. Stuffer box crimping here takes place within the cylindrical channel. The yarn leaves the channel without tension. This is in contrast with the actual texturing where the tension produced in the yarn at the outlet from the nozzle provides a measure of the quality of the texturing operation. Texturing was previously often understood in the most general sense and was not taken as a technical concept.

EXPLANATION OF THE INVENTION

The object of the present invention was to optimize the processing operation in the production of a loop yarn. A portion of the object of this method is then in particular to allow higher yarn transport speeds without any loss of quality..

The method according to this invention is characterized in that the yarn is heated between a first feeder roll and a second feeder roll by an upstream and/or downstream yarn heating device such that both the mechanical air effect and the thermal effect take place between the first feeder roll and the second feeder roll.

Figure 2:
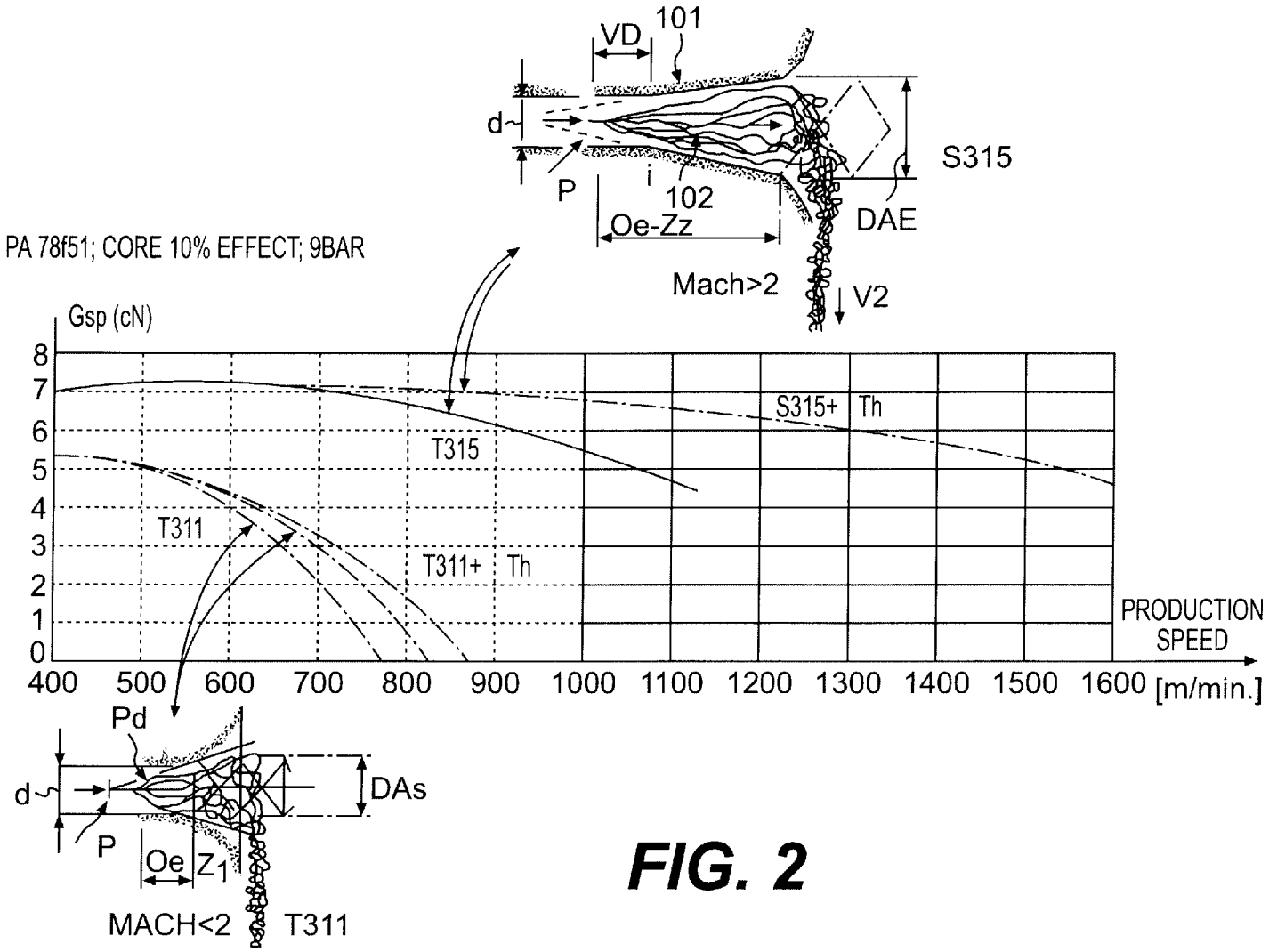

FIG. 2 shows with curve T311 a purely schematic diagram of texturing according to the state of the art as stipulated in International Patent WO97/30200. Two main nozzle parameters are emphasized: an opening zone Oe-Z1 and an impinging front diameter DAs starting from a diameter d of the nozzle yarn channel. On the other hand, the diagram shows texturing according to the teaching of International Patent WO97/30200 with an increased output at the upper right of the diagram. This shows very clearly that the values Oe-Z2 and $D_{AE}$ are greater in comparison with those obtained with nozzle T311. Yarn opening begins before the acceleration channel in the area of compressed air supply P, i.e., in the cylindrical section. VO is the pre-opening. Mass Vo is preferably greater than d. The main information from FIG. 1 is the diagramed comparison of the yarn tension Gsp (cN) according to curve T311 at Mach< 2 and a texturing nozzle according to curve S 315 at Mach> 2. The yarn tension is given in cN in the verticals of the diagram. The horizontals show the production speed Pgeschw in m/min. Curve T311 shows the rapid collapse in yarn tension at production speeds of 500 m/min. Above approximately 650 m/min, texturing collapsed. In contrast with that, the curve S 315 shows that the yarn tension is not only much higher but is almost constant in the range of 400 to 700 m/min, and also drops more slowly in the higher production range. The increase in Mach number is one of the most important "secrets" for making progress in increasing production output according to International Patent WO97/30200. It was completely surprising that the increase in production output was not exhausted at all with the special design of the acceleration channel. Two central findings make it possible to open another gate to even higher speeds with no loss of quality, namely the additional combination of:

a higher air pressure, and a thermal treatment before and/or after texturing.

Although in practice, one cannot speak of strictly separate stages in the actual sense, such a representation still comes very close to the actual situation. If a production speed of 1200 m/min is assumed according to the present invention, then 250 m/min of that is due to the increase in pressure to 10–12 bar and an additional 200 m/min is due to the further increase to 12–14 bar (in addition to the effect of heat). According to experiments so far, a further increase in output is readily possible. With an increase in pressure to more than 8 or 9 bar, this merely creates the prerequisite for increasing the Mach number. This is especially effective if the texturing nozzle is designed according to the teaching of International Patent WO97/30200. It may be assumed that even greater increases to 1500 m/min or even more are possible accordingly. According to experiments so far, there is no upper limit to the production rates that can be achieved. Furthermore, another interesting observation is that the thermal effect alone either upstream and/or downstream from the texturing nozzle itself would yield an increase in output with an old nozzle with Mach< 2. This new invention has shown that there are causal relationships between the increase in pressure, Mach number, yarn transport rate and thermal influence. The stiffness of the individual filaments is reduced with the heat treatment upstream from texturing. Filaments can bend more easily and with less energy when they are warm, which is the main reason for this component. With the heat treatment arranged downstream from texturing, the change in structure that takes place in texturing is more complete. One possible explanation for the surprisingly great effect of the thermal treatment is that with a simultaneous increase in yarn throughput speed, the period of time for possible cooling is also reduced in half Thus, the heat effect is manifested to a greater extent. For especially advantageous embodiments, reference is made to claims 2 through This invention also concerns a yarn finishing machine and is characterized in that a yarn heating device DK1, DK2 is arranged between two feeder rolls. One heating device DK1 may be located downstream from the texturing nozzle TD and upstream from the second feeder roll LW2, for example, while the other heating device DK2 may be located upstream from the texturing nozzle TD and downstream from the first feeder roll LW1, for example. This invention also relates to the use of a heat treatment upstream and/or downstream from a texturing nozzle that produces an accelerated air flow at supersonic speed, for example more than Mach 2 in the acceleration channel.

BRIEF DESCRIPTION OF THE INVENTION

Figure 4:
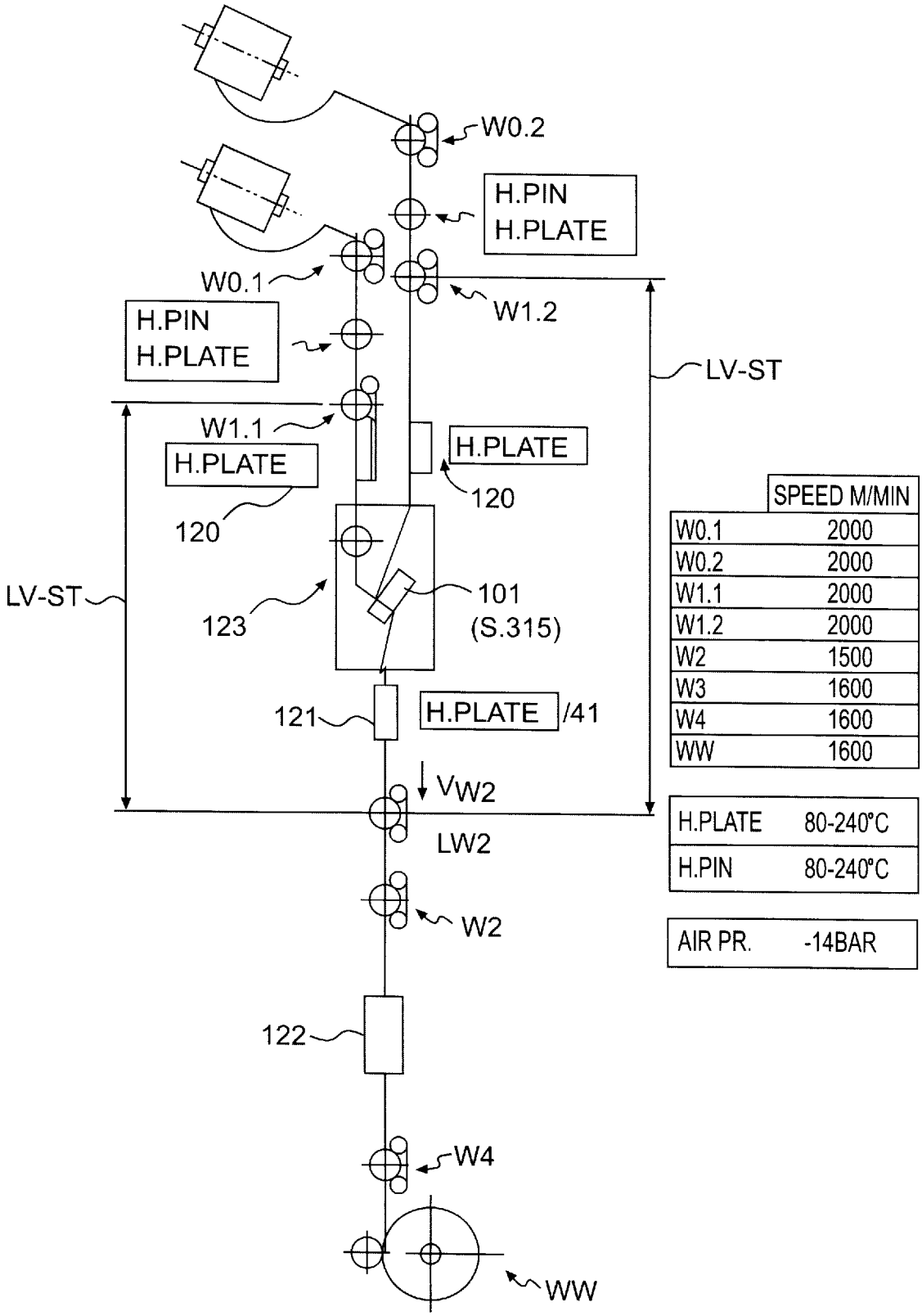
Figure 5A:
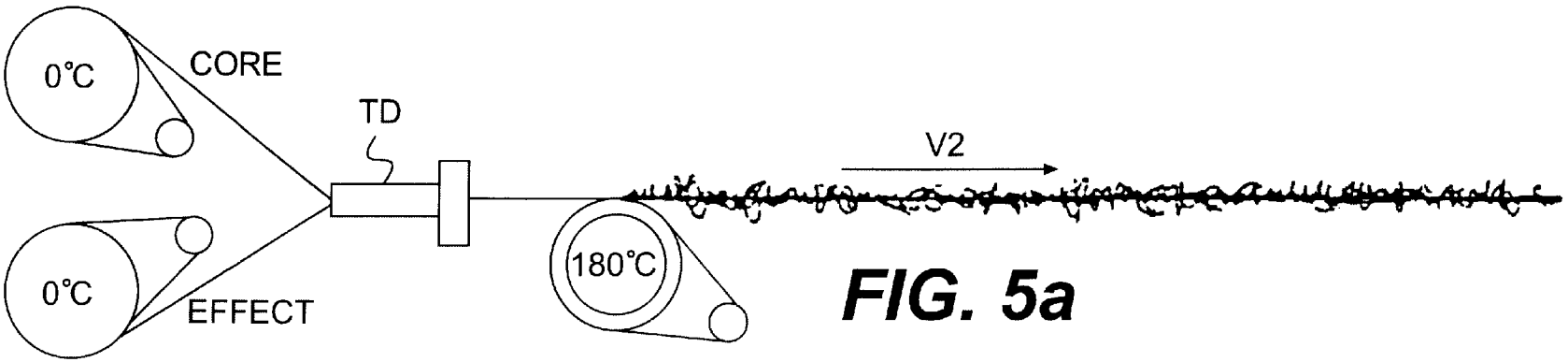
Figure 5B:
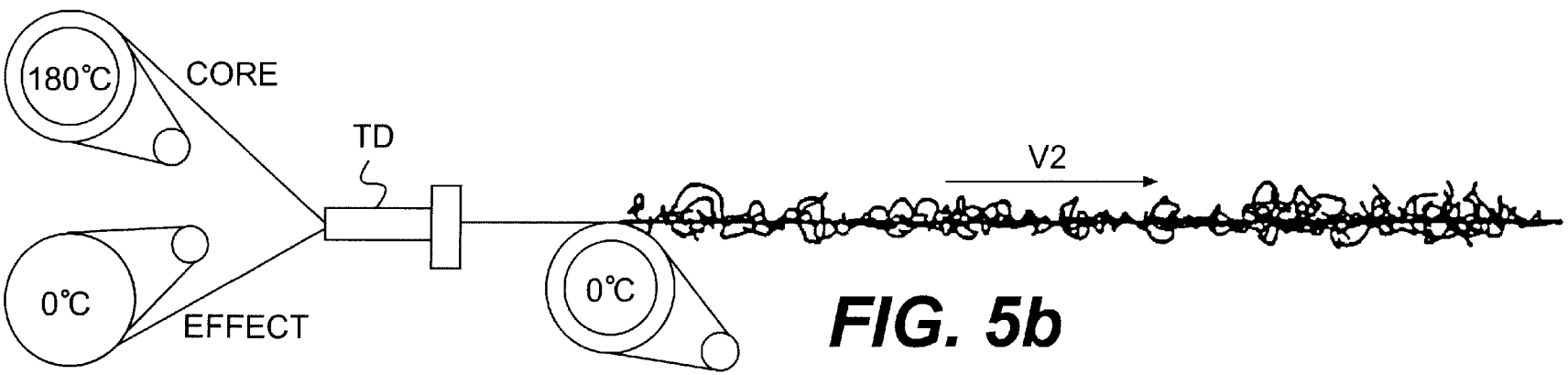
Figure 5C:
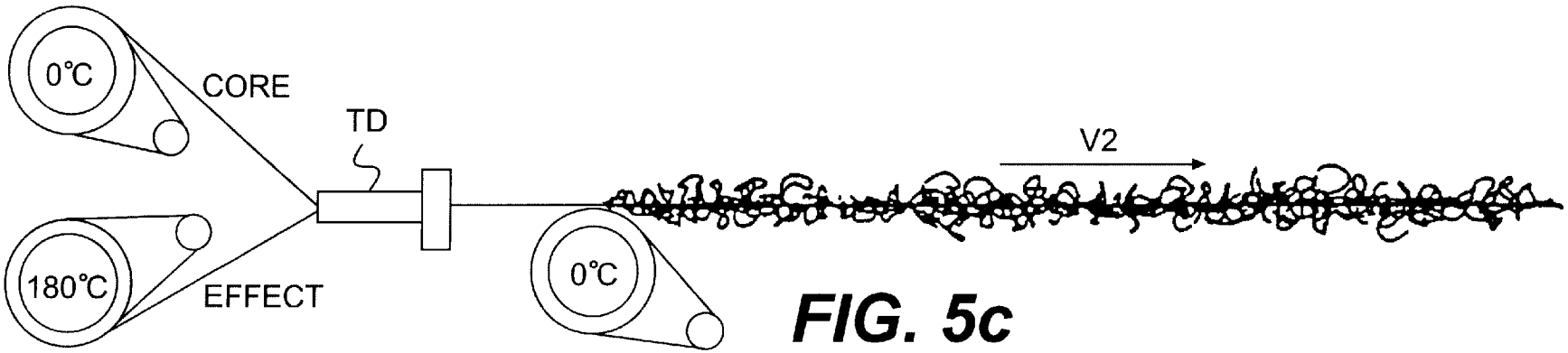
Figure 5D:
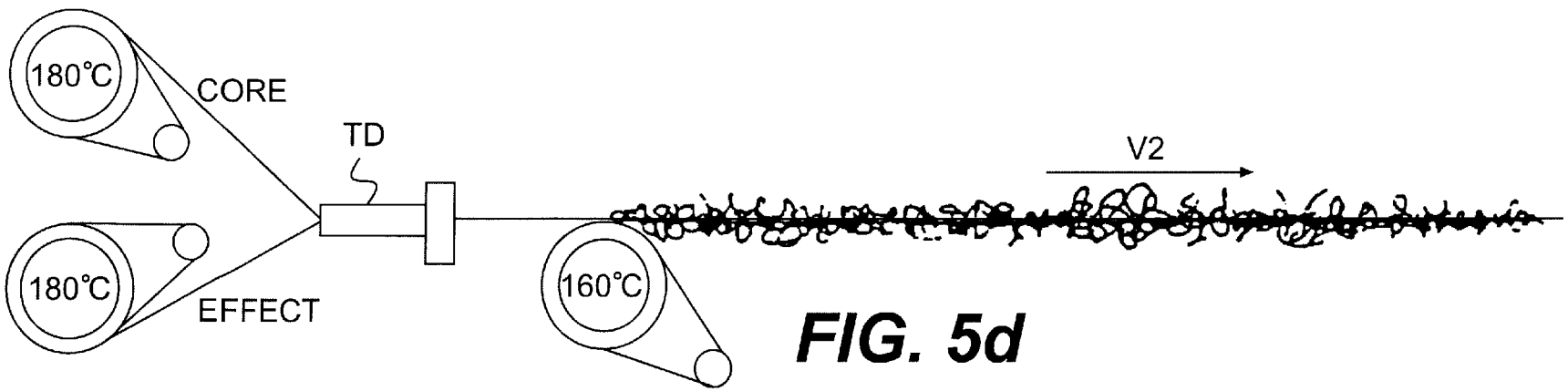
Figure 6:
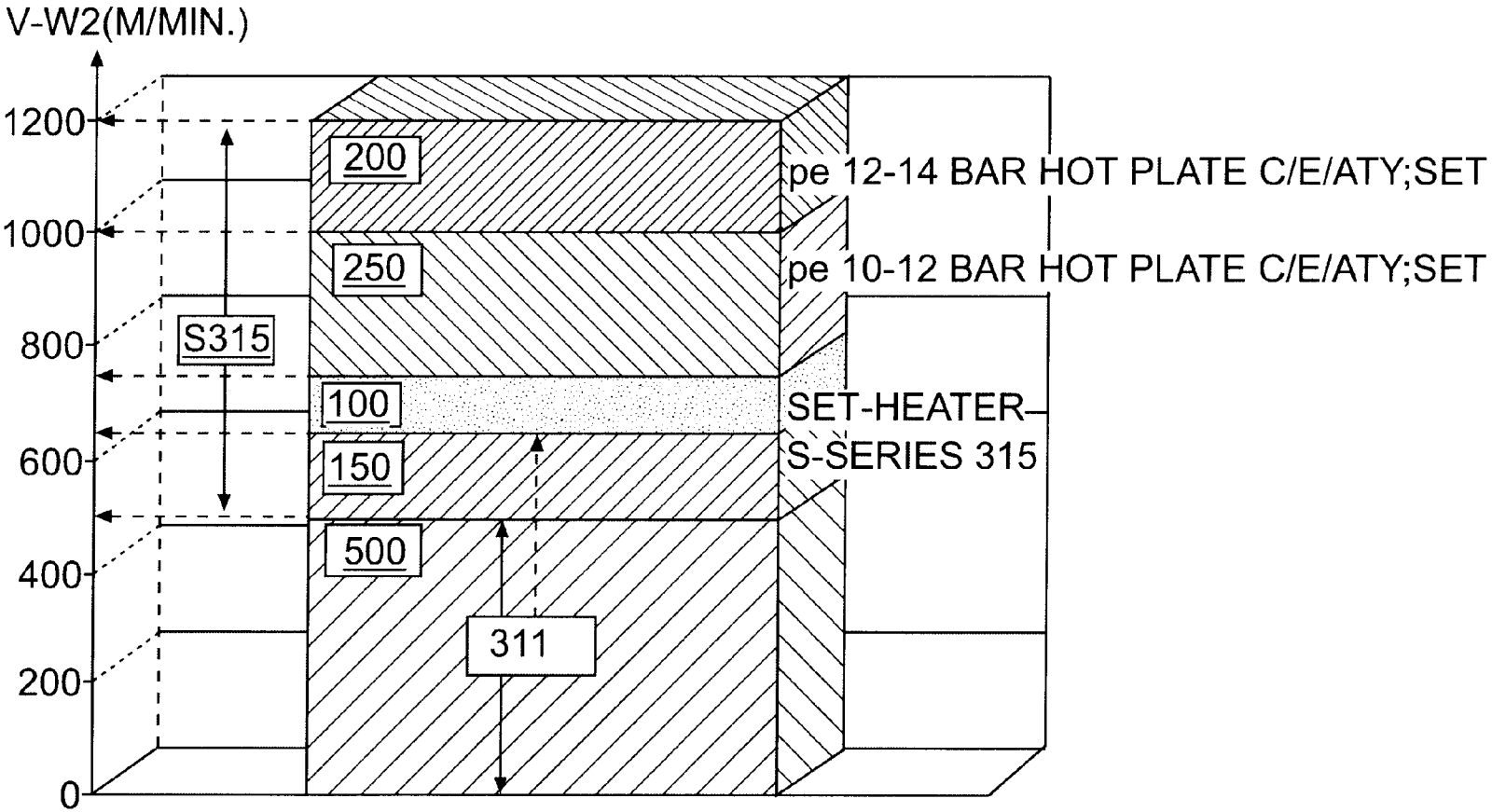

The present invention is described in greater detail below on the basis of several embodiments, showing:

FIG. 1: a survey of the new texturing process;

FIG. 2: a comparison of a texturing nozzle with Mach> 2 and a texturing nozzle with Mach< 2;

FIGS. 3*a* through 3*e:* the state of the art with respect to texturing;

FIG. 4: a texturing zone according to this invention;

FIGS. 5*a* through 5*d:* different variants for use of heat treatments;

FIG. 6: possible performance stages through a combination if various embodiments.

METHODS AND IMPLEMENTATION OF THE INVENTION

Reference is made to FIG. 1, showing a schematic diagram with respect to the new texturing process. The separate steps of the process are shown in succession from top to bottom. A smooth yarn 100 is conveyed over the first feeder roll LW1 at a given transport speed V1 to texturing nozzle 101 and through yarn channel 104. Highly compressed, preferably unheated air is blown at an angle $\alpha$ in the direction of the transport of the yarn into yarn channel 104 through compressed air channels 103 connected to a compressed air source PL. Immediately thereafter, the yarn channel 104 opens conically such that a greatly accelerated air flow at a supersonic speed, preferably at more than Mach 2, is established in conical section 102. The shock waves from the supersonic air flow produce the actual texturing effect. The first section of the air injection zone 105 where air is blasted into yarn channel 104 up to the first section of the conical enlargement 102 serves to loosen and open the smooth yarn so that the individual filaments are exposed to the supersonic air flow. Texturing is achieved according to the available air pressure (9 to 12 or even 14 bar or more) either within conical section 102 or in the outlet area. There is a direct proportionality between the Mach number and texturing. The higher the Mach number, the greater the impinging effect and the more intense the texturing. Two critical parameters obtained from the production speed:

the desired quality standard, and flapping, which can lead to a collapse of texturing with a further increase in transport speed.

The following abbreviations are used:

Th. vor.: thermal pretreatment, optionally with heating of the yarn or with superheated steam, G. mech.: yarn treatment with the mechanical effect of a compressed air flow (supersonic air flow), Th. nach.: thermal aftertreatment with superheated steam (possibly only heat or only superheated steam), D: steam PL: compressed air.

Production speed was successfully increased up to 1500 m/min with an additional thermal treatment without any collapse of texturing and without any flapping, where the limit was determined on the basis of the existing experimental facility. The best texturing quality was achieved at a production speed of far more than 800 m/min. Surprisingly, the inventors have discovered one or two completely new quality parameters, although the principle defined above (higher Mach number=greater impinging=more intense texturing) was confirmed in all the experiments. The parameters discovered include first a heat treatment upstream and/or downstream from texturing and secondly an increase in Mach number due to the increase in air pressure and a corresponding design of the acceleration channel. During the heat treatment, the yarn may be heated to more than 90 degrees Celsius.

a) Thermal Aftertreatment or Relaxation

An Important quality criterion in texturing is evaluated by those skilled in the art on the basis of the yarn tension of the yarn exiting from the texturing nozzle, which has been acknowledged as a measure of the intensity of the texturing effect. The yarn tension of textured yarn 106 is established between the texturing nozzle TD and feeder roll LW2. In this range, i.e. between texturing nozzle TD and feeder roll LW2, a thermal treatment was performed on the yarn under tensile stress. The yarn was heated to approximately 180 degrees Celsius. Preliminary experiments have already been concluded successfully using both a hot pin or heated rollers and a hot plate (non-contact), with the surprising result that the quality limit with respect to transport speed could be increased massively. At the present time, it is assumed that the thermal aftertreatment described here has a fixative effect and at the same time has a shrinkage effect on the textured yarn, thereby supporting the texturing effect.

b) Thermal Pretreatment

It was even more surprising that thermal pretreatment also has a positive effect on the texturing operation. The reason for this success here might be due to a combination effect of yarn shrinkage and yarn opening that takes place in the section between the point of air injection into the yarn channel and the first partial segment of conical widening in the range of ultrasonic velocity. Since the yarn is heated, its stiffness is reduced, thus improving the prerequisite for loop formation in the texturing process. Here again, experiments have been successfully concluded with both hot plate and hot pin elements as heat sources. The fact that a negative cooling effect due to air expansion in the texturing nozzle is avoided with thermal pretreatment of the yarn might also be a supporting factor here, and therefore, texturing of the heated yarn is improved. At very high transport speeds, a portion of the heat remains in the yarn itself up to the area of loop formation.

Using a processing medium D can maximize the effect of the thermal treatment. An example of a processing medium D is superheated steam supplied through a channel 114 into a treatment body DK1, DK2. Other possible mediums include hot air or some other type of hot gas, for example. The treatment body DK1, DK2, as shown in FIG. 1, may be a closed flow-through steam chamber 41 formed as a closed nozzle defining a medium feed channel 41*a* with a large cross section. A two-part treatment body DK1, DK2 approximately symmetrical in both parts and approximately the same shape in both nozzle halves may be used, as shown in FIG. 1.

If the effect is maximized by a processing medium—whether hot air, superheated steam or some other hot gas—then preferably the additional thermal process steps are separated locally or are carried out on the running yarn shortly or directly in succession. The process measures are not isolated in this way but instead are combined in a shared action between two feeder rolls. This means that the yarn is secured only at the beginning and at the end, while both the mechanical action of air and the thermal action on the yarn take place between the feeder rolls. The thermal treatment is performed at the tensions produced mechanically in the filments or in the yarn by the compressed air.

FIG. 2 gives an overview of yarn tension (Gsp) and production speed. The lower portion of the figure at the left shows the result obtained with a nozzle T311, where the yarn was heat treated with T311+Th. The dash-dot lines T311+Th are only the result of sampling experiments. In the upper part of the figure, a nozzle S 315 with an acceleration channel for Mach> 2 is used. The air pressure used as the basis for texturing is not shown in the two curves. The dash-dot curve S 315+Th shows mainly the great effect of the heat treatment. Since a plurality of yarn grades and yarn titers are available, it was impossible to accurately determine the corresponding relationships. According to experience in textile technology, this can be done only in actual production use.

However, FIG. 2 illustrates the steps in increasing production with the various combinations. A PA 78151, core 10%, effect 30% and a pressure of 9 bar were used as the reference material.

Figure 3C:
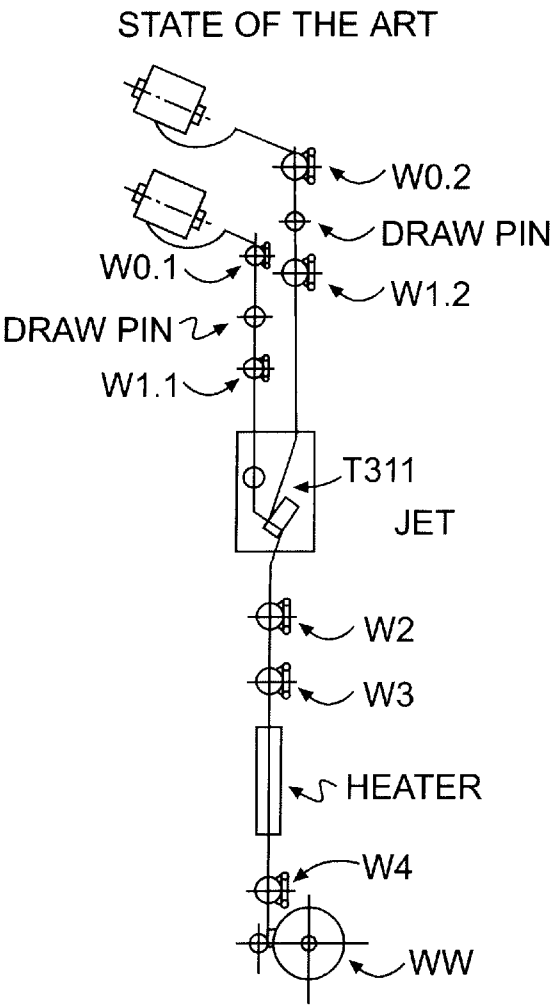
Figure 3B:
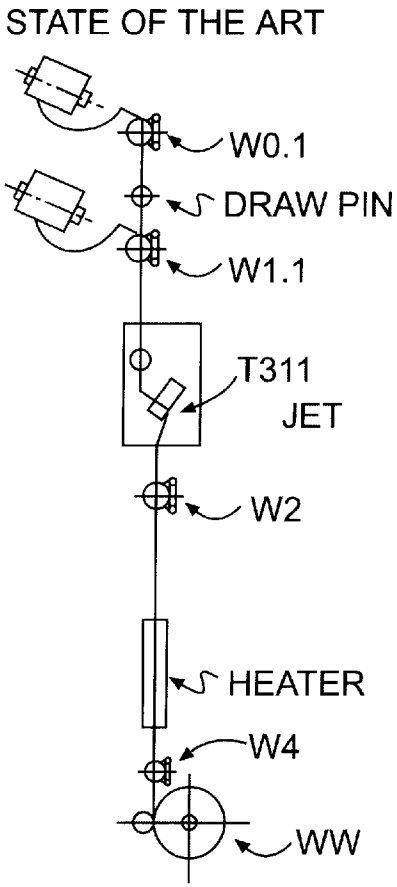
Figure 3A:
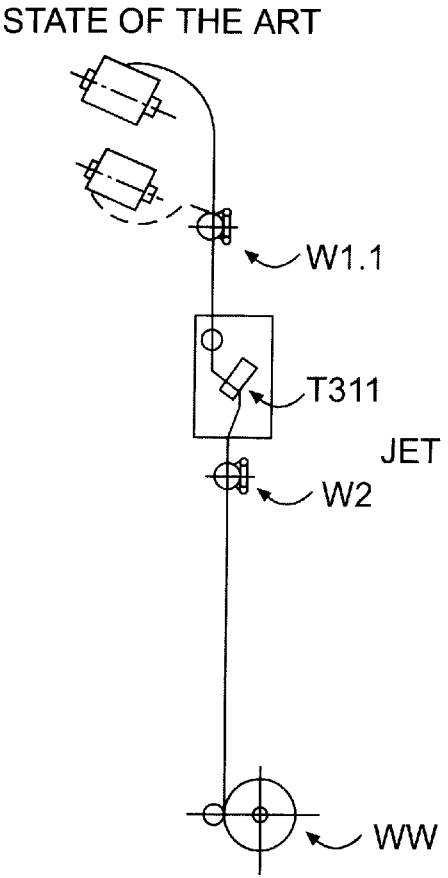
Figure 3D:
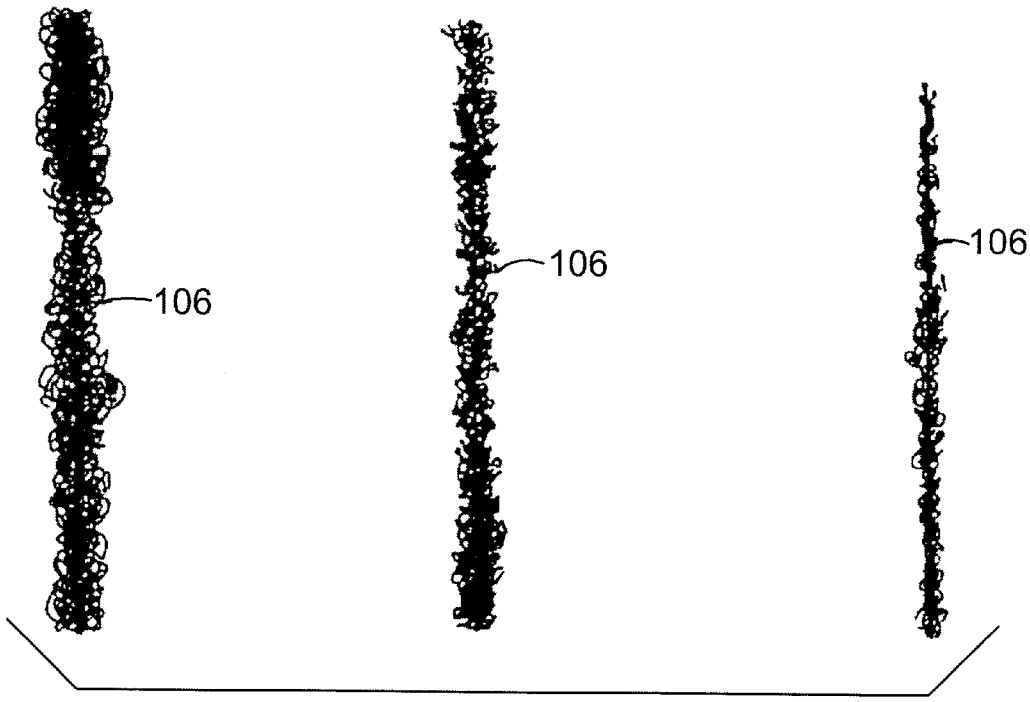
Figure 3E:
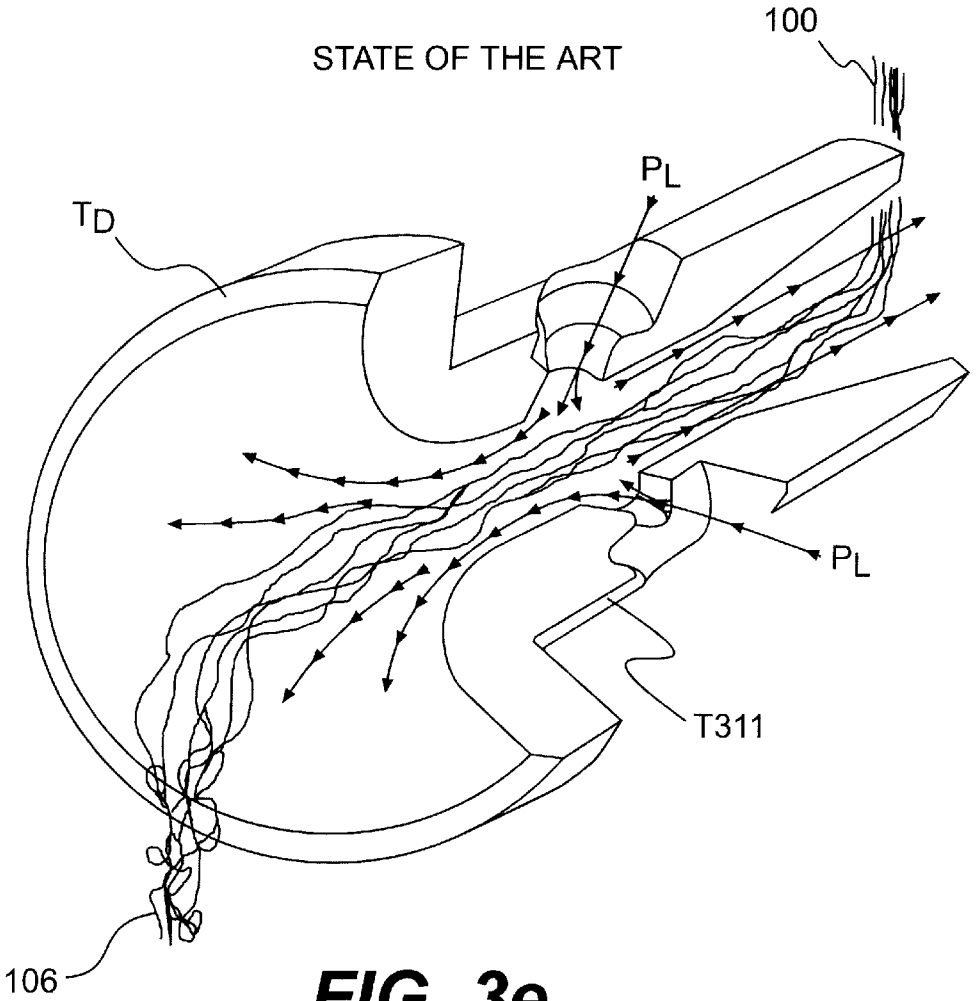

FIGS. 3*a* through 3*e* show the typical solutions according to the state of the art with various feeder rolls W0.1, W0.2, W1.1, W1.2, W2, W3, W4, WW operating at various speeds, some examples of which are shown in FIG. 4. FIG. 3*a* shows schematically the known individual or parallel processing of FOY yarn. FIG. 3*b* shows parallel processing of FOY and POY yarns. FIG. 3*c* shows the processing of POY yarn with core yarn and effect yarn. FIG. 3*d* shows examples of various embodiments of textured yarns 106 and FIG. 3*e* shows a classical texturing nozzle. The texturing nozzle TD shown in FIG. 3*e* is a T311 nozzle, with smooth yarn 100 being subject to compress air PL in the texturing nozzle TD resulting in textured yarn 106.

FIG. 4 shows schematically according to FIG. 3 the use of the new solution in texturing. In contrast with the diagram in FIG. 1, a so-called hot plate (H.plate) is used for the thermal treatment, i.e., a non-contact heating channel as illustrated in FIGS. 3*b* and 3*c*. The entire air processing stage is labeled as LvSt in FIG. 4 in a diagram according to FIG. 1. FIG. 4 shows a thermal pretreatment 120 as well as a thermal aftertreatment 121, with the most important process data including the air pressure, temperature and yarn speeds. H.plate means hot plate and H.pin means hot pin. A yarn moistening step HemaJet 123 is arranged upstream from the texturing nozzle 101. Downstream from the air finishing stage, the yarn is usually drawn or subjected to a drawing operation by a few percentage points (1–2%). Then the yarn is passed over another heater 122 which may also be a steam chamber. If superheated steam is used for the thermal treatment at one station, it may be advisable for economic reasons to also design the other heating stations to operate with superheated steam. The table shows the yarn speeds at the feeder rolls (W) indicated as an example.

FIGS. 5*a* through 5*d* illustrate the use of the so-called heated and driven rollers for thermal treatment with a few possible applications. The temperature shown in the roller indicates whether or not it is a heated position. Accordingly, a hot plate or a through-flow steam chamber may also be used in all embodiments.

FIG. 6 illustrates very roughly in diagram form the increase in speed ranges, with the possible increase in production speed for an identical texturing quality shown in each case. The blocks shown here represent different combinations for the texturing process from bottom to top. The upper half of the figure shows transparencies according to FIGS. 1, 4 and 5, illustrating the increased production achieved, or the production speed while maintaining a certain predetermined yarn quality.

Block 500 shows the state of the art with a texturing nozzle T311 according to FIG. 3*e* at 9 bar, 500 m/min.

Block 150 shows a texturing nozzle S 315. Experiments have shown that block 150 is also possible with a nozzle T311 with an additional thermal process. This is indicated with a dash-dot arrow.

Block 100 also shows a set heater.

Block 250 also shows a thermal aftertreatment (FIG. 5*a*) at 10–12 bar and with a hot plate C/E/ATY; SET.

Block 200 also shows a thermal pretreatment (FIG. 5*d*) at 12–14 bar with a hot plate C/E/ATY; SET.

The increase in production according to blocks 250 and 200 was achieved at a constant quality using only one texturing nozzle, i.e., at more than Mach 2 in the acceleration channel 104. Block 250 presupposes a higher pressure and a heat treatment. Block 200 presupposes all the proposed measures. Block 150 may optionally be achieved with a nozzle T311 and thermal treatment.

This invention also relates to the use of at least one or two heat treatments upstream and/or downstream from a texturing nozzle at Mach> 2 in the acceleration channel.

What is claimed is:

1. A method for treating a continuous filament yarn comprising:

supplying the yarn in a drawn state to a first feeder roll;

supplying the yarn to an air jet texturing nozzle after supplying the yarn to the first feeder roll, wherein the nozzle defines a yarn channel having a substantially conical section;

air jet texturing the yarn in the nozzle via compressed air radially entering the yarn channel substantially at an entrance of the conically shaped portion, the air reaching at least supersonic speed in the yarn channel;

supplying the yarn to a second feeder roll after air jet texturing the yarn; and heating the yarn between the first feeder roll and the second feeder roll.

2. The method of claim 1, wherein the heating of the yarn occurs before the air jet texturing.

3. The method of claim 1, wherein the heating of the yarn occurs after the air jet texturing.

4. The method of claim 1, wherein the heating of the yarn occurs before and after the air jet texturing.

5. The method of claim 1, wherein the heating of the yarn includes heating the yarn to more than 90 degrees Celsius.

6. The method of claim 1, wherein the heating of the yarn includes heating the yarn via a steam chamber.

7. The method of claim 1, wherein the heating of the yarn is via one of a hot plate and a hot pin.

8. The method of claim 1, wherein the heating of the yarn is via superheated steam.

9. The method of claim 1, wherein the heating of the yarn includes passing the yarn through a treatment chamber.

10. The method of claim 1, wherein the treatment chamber comprises:

a flow-through steam chamber; and a closed nozzle.

11. The method of claim 1, wherein the texturing of the yarn includes texturing the yarn via compressed air supplied at a pressure of more than about 8 bar.

12. The method of claim 1, wherein the texturing of the yarn includes texturing the yarn via compressed air supplied at a pressure of more than about 10 bar.

13. The method of claim 1, wherein the air reaches a speed of greater than about Mach 2 in the yarn channel.

14. The method of claim 1, wherein the yarn exits the texturing nozzle at a speed greater than about 600 m/min.

15. The method of claim 1, wherein the yarn exits the texturing nozzle at a speed greater than about 800 m/min.

16. The method of claim 1, wherein the yarn exits the texturing nozzle at a speed greater than about 1500 m/min.

17. The method of claim 1, wherein the conically shaped portion of the nozzle expands in a downstream direction.

18. The method of claim 1, wherein the compressed air enters the yarn channel substantially at a central section of the channel.

19. The method of claim 1, further comprising placing the yarn under tension after the yarn exits the air jet texturing nozzle.

20. A device for treating a continuous filament yarn, the device comprising:

a first feeder roll;

a means for supplying drawn yarn to the first feeder roll;

an air jet texturing nozzle defining a yarn channel having a conically shaped portion, the air jet texturing nozzle disposed downstream from the first feeder roll;

a compressed air supply configured to radially enter the yarn channel substantially at an entrance of the conically shaped portion of the yarn channel such that the air reaches at least supersonic speed in the yarn channel;

a second feeder roll disposed downstream from the air jet texturing nozzle; and at least one heating element disposed downstream from the first feeder roll and upstream from the second feeder roll.

21. The device of claim 20, wherein the at least one heating element is disposed upstream from the air jet texturing nozzle.

22. The device of claim 20, wherein the at least one heating element is disposed downstream from the air jet texturing nozzle.

23. The device of claim 20, wherein the at least one heating element includes a first heating element disposed upstream from the air jet texturing nozzle and second heating element disposed downstream from the air jet texturing nozzle.

24. The device of claim 20, wherein the heating element is chosen from one of hot pin and a hot plate.

25. The device of claim 20, wherein the heating element includes a steam chamber.

26. The device of claim 20, wherein the heating element is configured to heat the yarn to more than 90 degrees Celsius.

27. The device of claim 20, wherein the air jet texturing nozzle is configured such that the compressed air reaches a speed greater than about Mach 2.

28. The device of claim 20, wherein the device is configured such that the yarn has a speed greater than about 600 m/min as it travels through the texturing nozzle.

29. The device of claim 20, wherein the device is configured such that the yarn has a speed greater than about 800 m/min as it travels through the texturing nozzle.

30. The device of claim 20, wherein the device is configured such that the yarn has a speed greater than about 1500 m/min as it travels through the texturing nozzle.

31. The device of claim 20, wherein the compressed air supply has a pressure of more than about 8 bar.

32. The device of claim 20, wherein the compressed air supply has a pressure of more than about 10 bar.

33. The device of claim 20, wherein the compressed air supply is configured to enter the yarn channel substantially at a central section of the yarn channel.

34. The device of claim 20, wherein the second feeder roll is configured to place the yarn under tension as it exits the texturing nozzle.

35. The device of claim 20, wherein the conically shaped portion of the yarn channel expands in a downstream direction.

* * * * *